United States Patent [19]

Semerjian et al.

[11] 4,449,436

[45] May 22, 1984

[54] SHEET PUNCH DEVICE

[75] Inventors: Joseph K. Semerjian, Franklin Park; Glenn R. Lodge, Mt. Prospect, both of Ill.

[73] Assignee: Wilson Jones Company, Chicago, Ill.

[21] Appl. No.: 357,736

[22] Filed: Mar. 12, 1982

[51] Int. Cl.[3] ..... B26F 1/02

[52] U.S. Cl. ..... 83/571; 83/549; 83/559; 83/563; 83/633; 83/698

[58] Field of Search ..... 83/571, 560, 618, 630, 83/688, 689, 553, 549, 559, 563, 633, 698

[56] References Cited

U.S. PATENT DOCUMENTS

| | | | |
|---|---|---|---|
| 2,405,150 | 8/1946 | Kern | 83/618 |
| 2,481,883 | 9/1949 | Semler | 83/618 X |
| 2,726,721 | 12/1955 | Segal | 83/560 |
| 4,036,088 | 7/1977 | Ruskin | 83/618 X |

FOREIGN PATENT DOCUMENTS

| | | | |
|---|---|---|---|
| 2631117 | 1/1978 | Fed. Rep. of Germany | 83/689 |
| 204506 | 10/1923 | United Kingdom | 83/553 |

*Primary Examiner*—James M. Meister
*Attorney, Agent, or Firm*—Pennie & Edmonds

[57] ABSTRACT

A lever operated sheet punch device having recesses to receive portable die mounts which mounts can be readily removed or replaced. When mounts are placed in the recesses, alignment means both on the mount and the recesses function to align and position the mounts in a selected position. To inactivate a mount it can be removed or its configured die head turned to a position where the lever will not operate it.

4 Claims, 9 Drawing Figures

SHEET PUNCH DEVICE

BACKGROUND OF THE INVENTION

1. Field of the Invention

This invention relates to punch devices for punching holes in sheets of paper, plastic and other materials and particularly to portable devices for punching a plurality of spaced-apart holes in one or more sheets.

2. Prior Art

Numerous devices have been proposed for punching spaced-apart holes in stacks of sheets. Devices for adjusting the spacing between holes punched include Unger U.S. Pat. No. 2,368,790 and Semler U.S. Pat. No. 2,481,883 which permit the punch dies to be moved back and forth on a slide guide to an infinite number of locations.

Other punch devices utilize dies which are mounted to operate in fixed relationship one with the other with one or more of the dies being capable of being temporarily deactivated; Emmer U.S. Pat. No. 2,558,044. Deactivation of dies can be accomplished by removal and relocation; Ruskin U.S. Pat. No. 4,036,088.

The present invention provides a novel arrangement for locating and deactivating dies of a punch device.

SUMMARY OF THE INVENTION

Broadly, the present invention comprises a punch device having a base, a housing supported on and spaced from the base, a plurality of punch dies mounted in portable die mounts, first alignment means on the portable mounts, an elongated walled recess in the housing having walls which walls include second alignment means for aligning in preselected positions the die mounts in such recess and lever means mounted on the housing for movement toward and away from the dies such that when such lever means is moved toward the dies it engages with the dies as mounted in the elongated recess to drive the dies through sheets on the base.

It is a feature of the punch dies that their tip section is formed to provide a plurality of surfaces with one surface having an area larger than the other to provide a cutting periphery of the tip so that the cutting takes places progressively as the punch die moves downwardly into and through the sheets.

DESCRIPTION OF THE PREFERRED EMBODIMENTS

Referring to FIGS. 1–5, punch device 1 includes base 2 which in turn supports an overhanging housing 3. These two elements are preferably molded as one piece but may be separately fabricated and then assembled.

Figure 1:
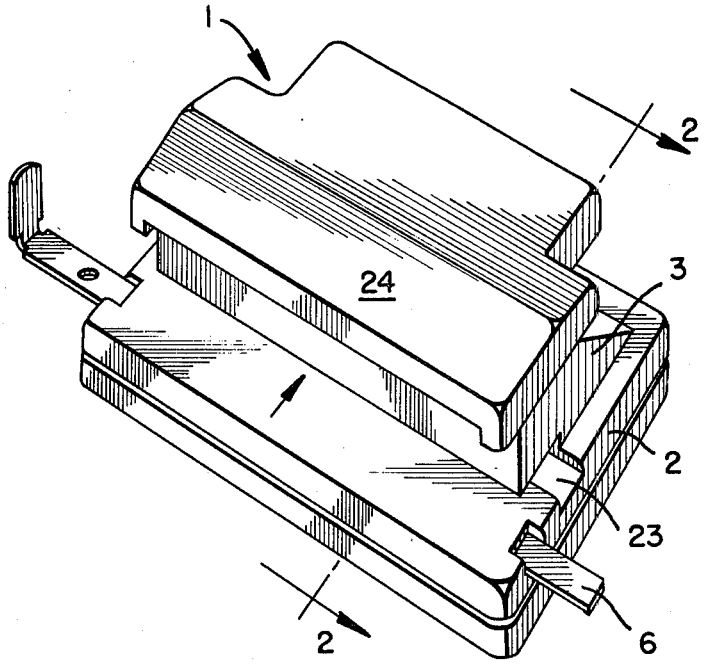
FIG. 1 is a perspective view of the punch device of this invention.
Figure 2:
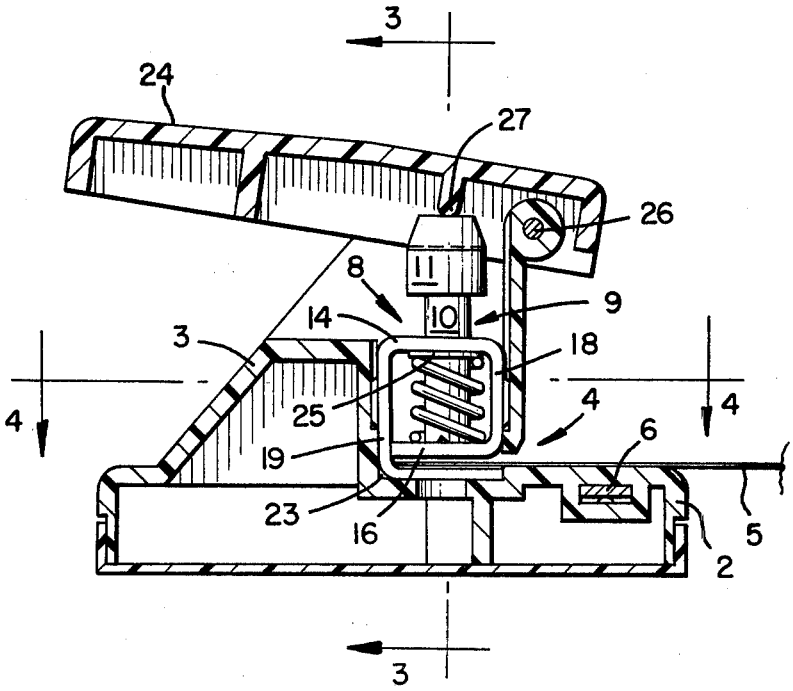
FIG. 2 is a sectional view taken along line 2—2 of FIG. 1.
Figure 3:
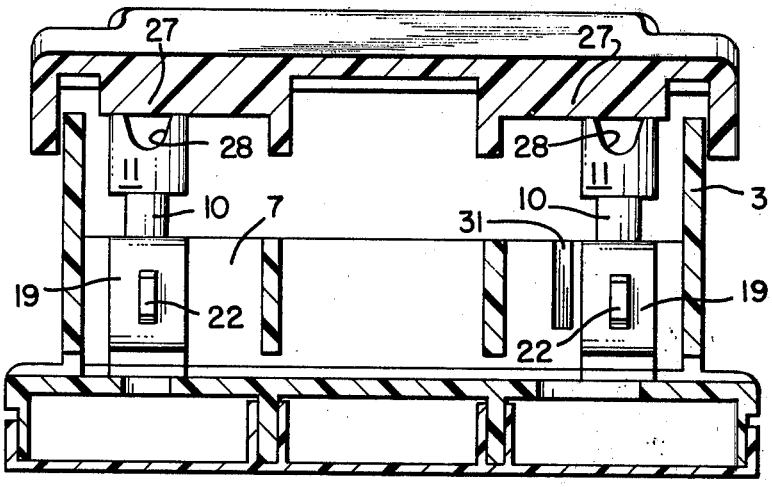
FIG. 3 is a sectional view taken along line 3—3 of FIG. 2.
Figure 4:
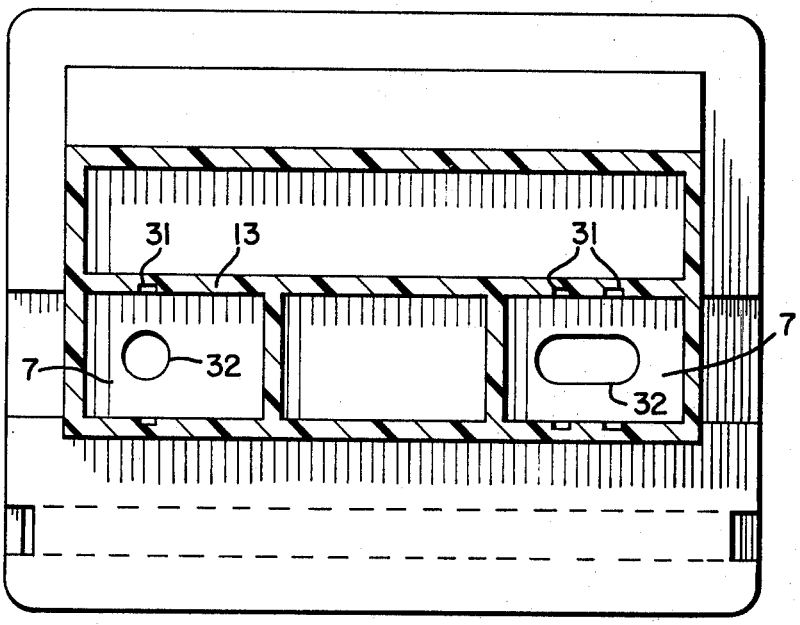
FIG. 4 is a sectional view taken along line 4—4 of FIG. 2.

Opening 4 between the base 2 and housing 3 provides space for insertion of the sheets 5 to be punched (see FIG. 2). Paper guide 6 assists in orienting and holding the sheets in the proper position for punching.

Figure 5:
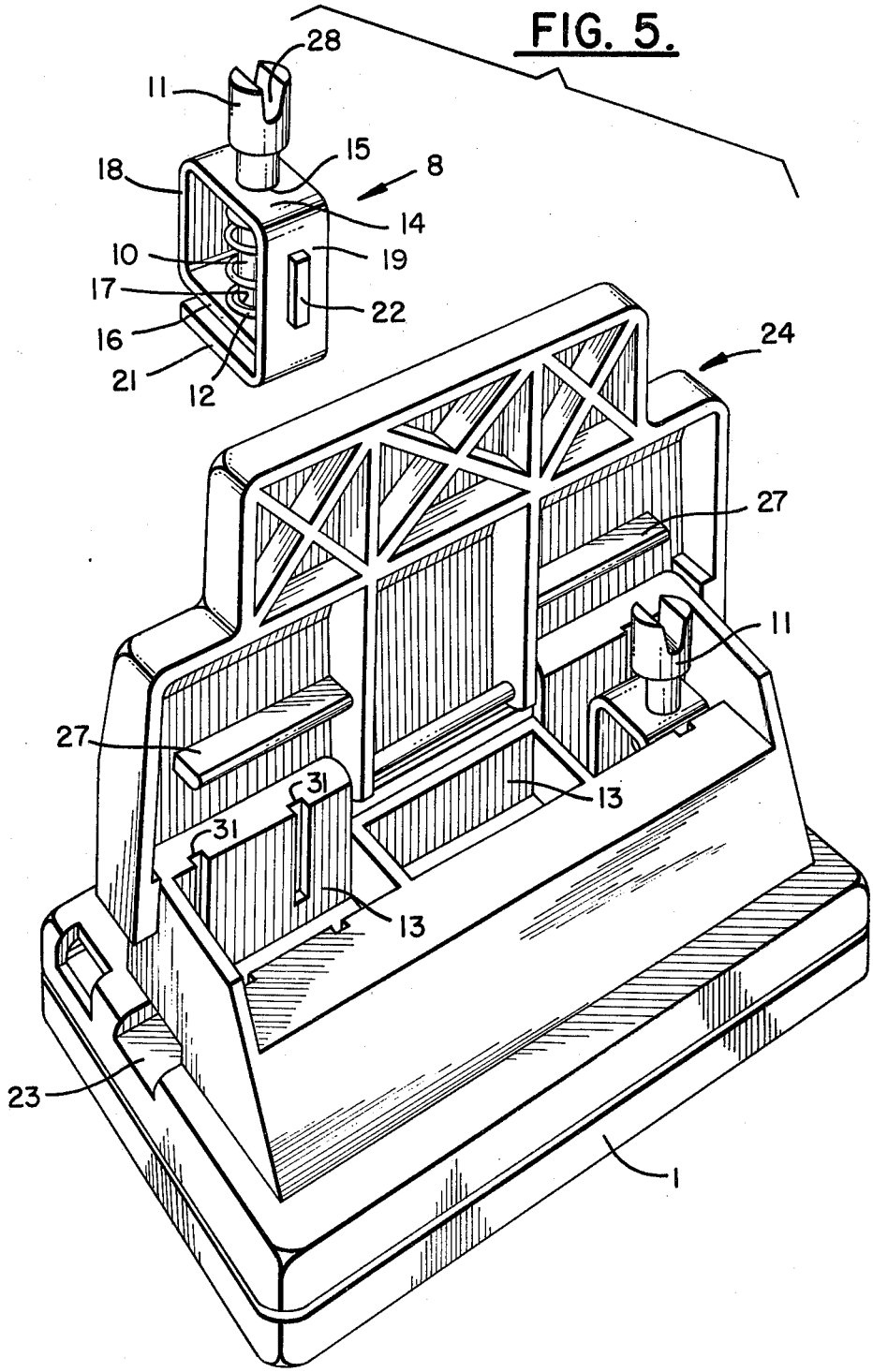
FIG. 5 is a prespective view with the cover open and a die unit exploded above the device.

Housing 3 has a plurality of rectangular walled recesses 7 in it for receiving and holding die holder units 8. Turning attention to FIGS. 2 and 5, each die unit 8 in turn comprises a frame, punch die 10, a grooved die head 11 and a spring 12. The frame includes top die guide element 14 having a round hole 15 to accommodate and support die 10 as it reciprocates during the punching operation. The frame also includes second die guide element 16 having a corresponding hole 17 to guide die 10 as it reciprocates. Short side element 18, long side element 19 and foot element 21 comprise the remaining portions of the frame. Alignment projections 22 are formed on or attached to side elements 18 and 19 to provide means for aligning the die units 8 at selected positions in recess slots 31 in walls 13 of recesses 7. Die units 8 may be placed in any pair of recess slots 31 or totally removed from the punch device. Groove 23 in base 2 has the depth and width to accommodate foot elements 21. Housing pivot cover 24 is pivotable about axis 26 to serve as both a cover and a lever arm to drive dies 10 downwardly to punch holes in the sheets. Springs 12 returns the dies 10 to their upper positions by urging retaining rings 25 attached to dies 10 upwardly against top elements 14. Pivotable cover 24 includes ribs 27 for engaging the top surfaces of die heads 11 when heads 11 are turned to their operative positions. Heads 11 have depressions 28 for receiving and harboring ribs 28 in such a way that ribs 28 do not engage heads 11 when cover 24 is moved downwardly against housing 3 which housing limits the downward movement of cover 24.

Vertical slots 31 are shaped to receive the alignment projections 22 of the die units 8 so that when a die unit 8 is placed in a recess 7 it will be selectively positioned and properly aligned at that position to cause the cutting dies 10 to reciprocate in the proper vertical plane so that the holes in stacks of sheets are properly spaced apart and are perpendicular to the plane of sheets.

Figure 6:
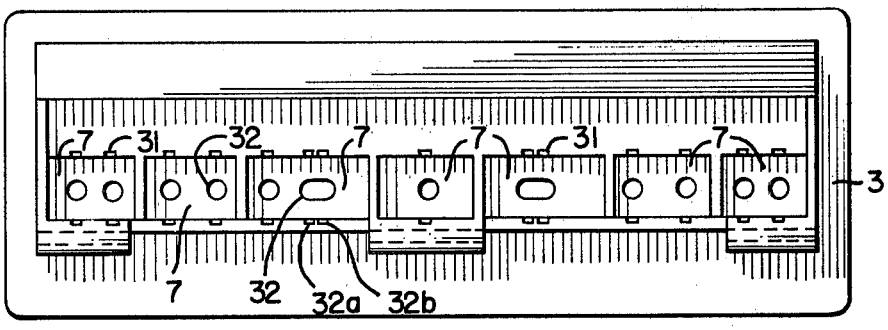
FIG. 6 is a plan view of an alternative punch unit for punching three (or more) holes.

Turning to FIG. 6, an alternative punch with seven recesses 7 each of which recess carries slots 31 and die-receiving openings 32. Oblong die openings 32 (see FIGS. 4 and 6) are used to permit the die 10 of a unit 8 to pass through the same opening whether the unit is positioned in a slot 31 or a closely adjacent slot 31. In FIG. 6, two (2) closely adjacent slots, for example, are 32*a* and 32*b*.

Figure 7:
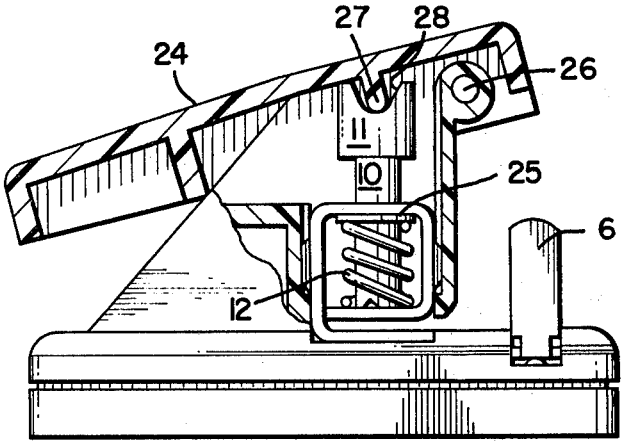
FIG. 7 is a sectional view similar to FIG. 2 with the die of a die unit turned to its inactive position.
Figure 8:
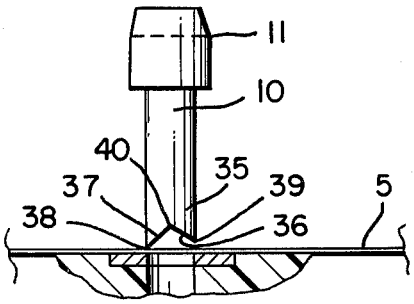
FIG. 8 is an elevational view of the die showing its hole cutting tip configuration.
Figure 9:
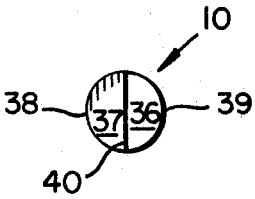
FIG. 9 is an end view of the cutting tip of a die.

FIG. 7 shows the die head 11 turned to its inoperative position with its depression 28 harboring rib 27; and, finally, FIGS. 8 and 9 shows a round die 10 having a round tip section 35 with two (2) end surface section 36 and 37 in which surface 37 has a greater area then surface 36. The surface sections 36 and 37 are positions at acute angles to the longitudinal axis of die 10. The cutting edges of the die which engage the sheet are the arcuate periphery of the tip section which periphery engages the sheets sequentially. The leading section 38 of the periphery engages the sheets first followed by the intermediate periphery section 39 and finally the remote periphery section 40 engages the sheet. This progressive sequence provides for better cutting of the sheets with reduced application of force required to operate lever cover 24.

We claim:

1. A sheet punch device comprising (a) a base;

(b) a housing supported on and spaced from the base to provide an opening for receiving sheets to be punched;

(c) a plurality of elongated punch dies with axes generally vertically oriented mounted in portable die mounts;

(d) at least one walled elongated recess in the housing having walls which walls include first alignment means generally extending a distance substantially parallel to the axes of the punch dies for positioning the die mounts in the recess;

(e) complementary alignment means on the portable mounts for engaging said recess alignment means when one or more portable die mounts are placed in the recess;

(f) the first alignment means and complementary alignment means being sized and shaped such that each die punch is aligned when and as it is placed in the recess; and (g) lever means mounted on the housing for movement toward and away from the dies such that when moved toward the dies it engages with the dies as mounted in the elongated recess to drive the dies through the sheets.

2. The sheet punch device of claim 1 in which each walled recess has a pair of parallel opposed walls with a first alignment means on each wall.

3. The sheet punch device of claim 2 in which each first alignment means is a slot in a wall.

4. The punch device of claim 1 in which the die mounts each include a reciprocal die with a head having a depression therein which head is capable of being moved to a first position in which the lever means engages the die head and to a second position in which the lever means is accommodated by the depression so that the die head is not engaged by the lever means during its movement downwardly toward the dies.

* * * * *